US005941252A

United States Patent [19]

Jenkins et al.

[11] Patent Number: 5,941,252

[45] Date of Patent: Aug. 24, 1999

[54] TRAY AND STAND FOR NAIL ART

[75] Inventors: Nevin C. Jenkins, Homosassa; Antonio Lebron, Spring Hill; Martin Fleit, Miami, all of Fla.

[73] Assignee: Fashion Nails, Inc., Homosassa, Fla.

[21] Appl. No.: 09/075,874

[22] Filed: May 12, 1998

[51] Int. Cl.[6] ..... A45D 29/00; A45D 29/18; A65D 1/34; A47B 73/00

[52] U.S. Cl. ..... 132/73; 132/73.5; 132/75; 206/561; 211/77

[58] Field of Search ..... 132/73, 73.5, 75; 211/77, 59.2, 131.1, 144; 206/561, 564, 557

[56] References Cited

U.S. PATENT DOCUMENTS

| | | | |
|---|---|---|---|
| 14,619 | 3/1856 | Moeller | 132/73 |
| 310,784 | 1/1885 | Bollinger | 211/77 |
| 1,728,512 | 9/1929 | Sharp | 211/131.1 |
| 2,245,929 | 6/1941 | Mangold | 132/73 |
| 3,070,906 | 1/1963 | Tinsley | 132/73 |
| 3,164,259 | 1/1965 | De'Caccia | 211/131.1 |
| 4,915,239 | 4/1990 | Persch | 211/74 |
| 4,968,253 | 11/1990 | Thomas | 434/100 |

*Primary Examiner*—John J. Wilson
*Assistant Examiner*—Trang Doan
*Attorney, Agent, or Firm*—Evenson, McKeown, Edwards & Lenahan, PLLC

[57] ABSTRACT

A nested tray and stand for holding a plurality of nail image material bottles. The stand has a rounded annular base plate with a hollow cylinder extending vertically from its inner rim. A receptacle for holding absorbent material saturated with a suitable solvent is defined at the upper part of the cylinder. A slotted cap closes off the top of the cylinder with absorbent material exposed through the slot. The tray is a molded annular configuration that slips over the stand and provides a series of peripherally recesses each of which recess can hold a bottle in a plurality of orientations.

5 Claims, 3 Drawing Sheets

TRAY AND STAND FOR NAIL ART

BACKGROUND OF THE INVENTION (a) Field of Invention

The present invention relates to a tray and stand for use with nail art.

(b) State of the Art

The popularity of nail art, the application of images as designs on fingernails and toenails, is rapidly developing worldwide. One aspect of nail art is the absence of accessories specially adapted for this purpose. In a recent development, a machine has been developed to apply nail art. The desirability of a device to hold a substantial number of containers of coloring material, readily accessible for selection and use, would be desirable in conjunction with the aforesaid machine.

SUMMARY OF THE INVENTION

Accordingly the principal object of this invention is to provide a novel stand and tray for holding a substantial number of containers for use in conjunction with a machine for applying nail art.

The foregoing object of the present invention is accomplished by providing a circular stand having a round base and central vertical hollow cylinder for holding squeegee cleaning materials. A slotted cover is received on the top of the cylinder. A circular tray having unique container receiving recesses nests on the stand and can be rotated relative thereto.

Other and further objects and advantages of the present invention will become readily apparent from the following detailed description of the preferred embodiment when taken in conjunction with appended drawings.

DETAILED DESCRIPTION OF THE INVENTION

Figure 1:
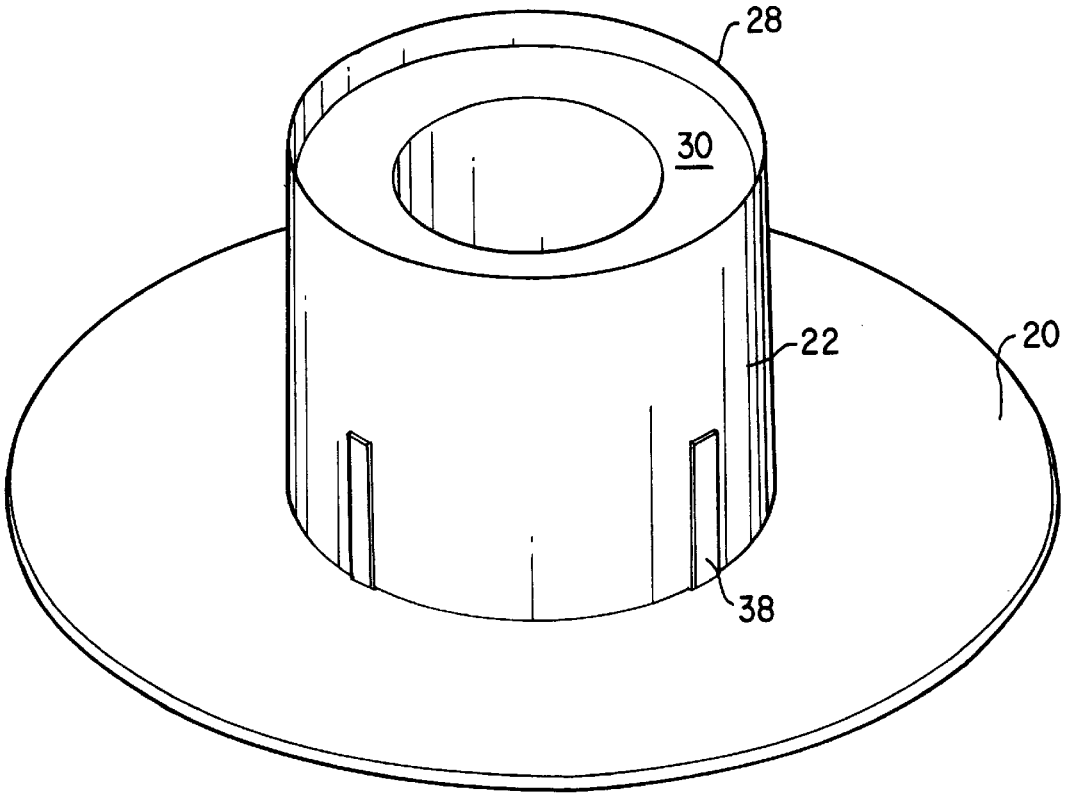
FIG. 1 is a perspective view of the novel stand.
Figure 2:
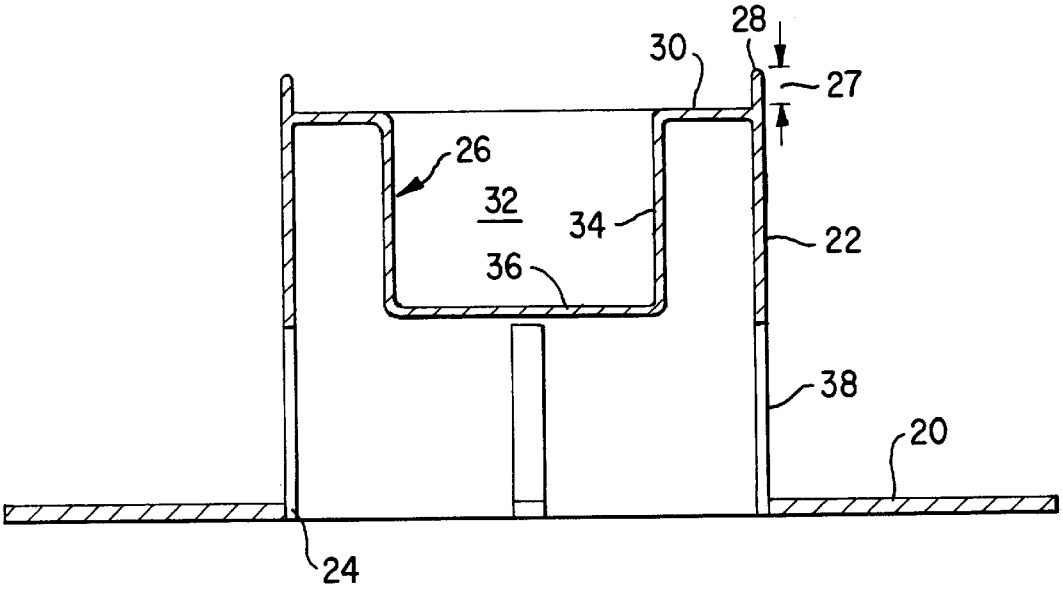
FIG. 2 is a vertical axial section of the stand.

A preferred embodiment of the inventive stand and tray is shown in the Figures. The stand is shown in FIGS. 1 and 2 and consists of an integrally molded unit or member having a flat circular annular base 20, a hollow cylinder 22 extending vertically from the inner rim 24 of base 20 and an internal divider 26 extending from adjacent, but a short distance 27 below, the top rim 28 of cylinder 22 inwardly a short distance to provide an annular platform 30 and then, vertically downwardly to about one-half the depth of cylinder 22 to form a receptacle or chamber 32 with a side wall 34 and bottom 36. Four slots 38 are equally spaced about cylinder 22 and extend from base 20 terminating just below the plane of floor 36.

Figure 3:
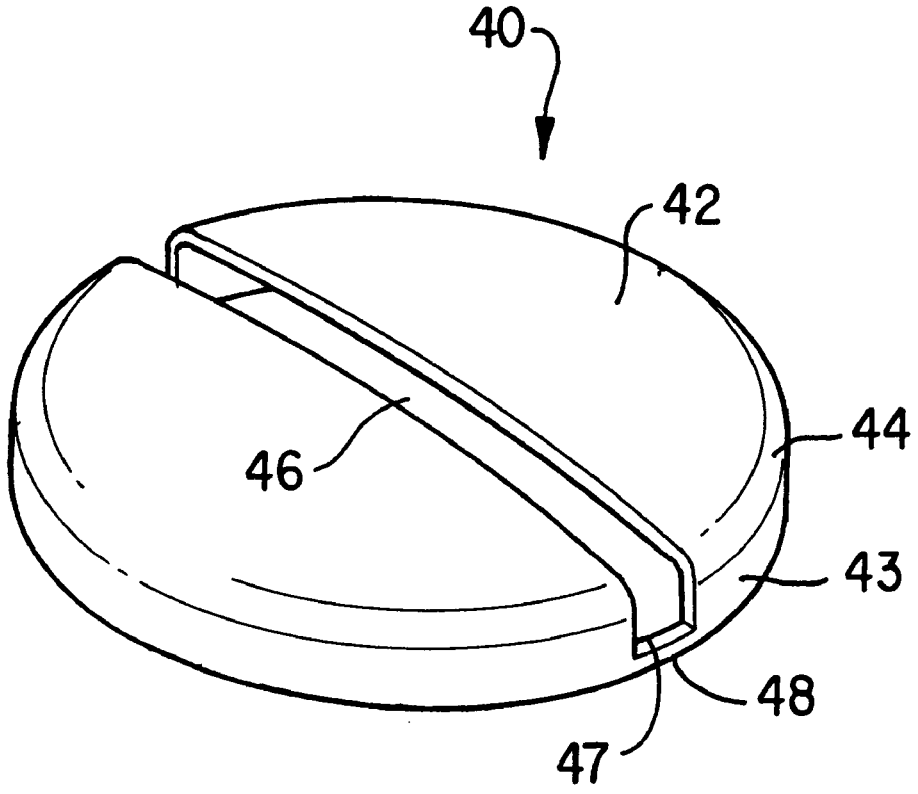
FIG. 3 is a perspective view of the slotted cap.

A slotted molded cap 40, shown in FIG. 3, consists of a round top 42 having a depending peripheral skirt 43. A bevel 44 is formed at the outer periphery of cap 40. A diametrical slot 46 penetrates top 42, skirt 43 and bevel 44, and terminates 47 adjacent the lower free edge 48 of skirt 43.

Figure 4:
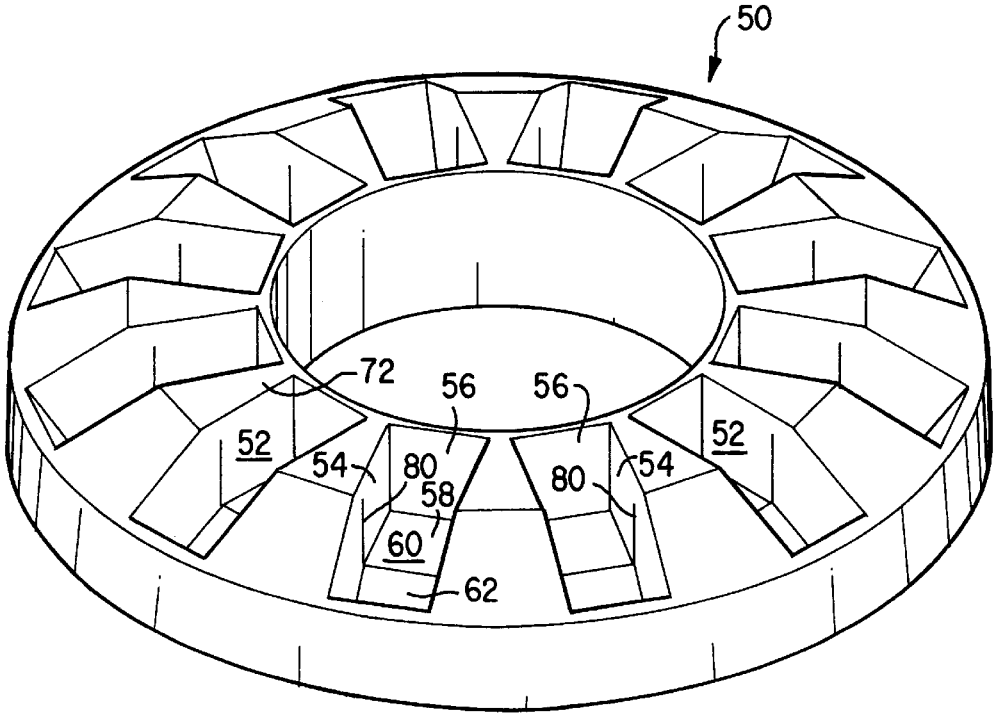
FIG. 4 is a perspective view of the novel tray.
Figure 5:
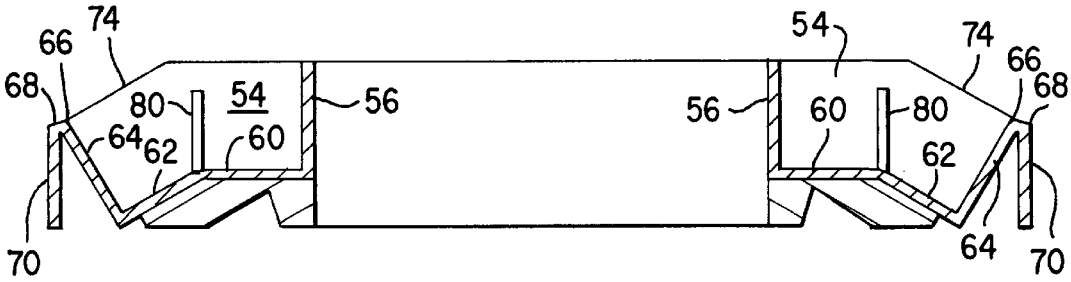
FIG. 5 is a vertical axial section of the tray.

The novel tray 50 is shown in FIGS. 4 and 5 and consists of an integrally molded part. The tray 50 is annular in configuration and its inner diameter allows it to slide over and down cylinder 22. The outer diameter of tray 50 matches that of base 20. Tray 50 defines a series of novel, rectangular in cross section, recesses 52, each consisting of opposed side walls 54, a back wall 56 and a two part floor 58. The inner part 60 of floor 58 is horizontal whereas the outer part 62 of floor 58 inclines outwardly, downwardly. A front wall 64 completes the recess and connects at its upper outer edge 66 with the upper edge 68 of the outer enclosing vertical skirt 70. The recesses 52 are interconnected by triangular shaped webs 72 which are integrally joined to edge 68 of skirt 70. Side walls 54 follow the line of the floor 58 and therefore, the outer part 74 of side walls 54 slope downwardly. A vertical rib 80 is molded on each side wall 54 just below the juncture of floor parts 60 and 62, so therefore, it extends from the top of part 62. Rib 80 projects inwardly so that opposed ribs 80 present a narrowing of the width of recess 52 at this point; like a throat.

The utilization of the stand and tray is as follows. The tray is placed on the stand in the manner previously described and can then be rotated manually relative to the stand. An absorbent material saturated with solvent such as cosmetic cotton balls or padding saturated with acetone or other nail polish remover is put into chamber 32 and on platform 30 to fill to the top edge 28 of cylinder 22. Cap 40 is put on the top of cylinder 22 so that the material is exposed through the slot 46. Image material containers (different colors), like nail polish, are received in recesses 52. The containers may be round, square or other shapes and may sit on horizontal floor part 60 in a vertical orientation. Also, the containers may rest on their sides on inclined floor part 62 in an inclined orientation. Further, due to ribs 80, the containers on floor part 60 can be tilted outwardly and held in any desired angular position when in use.

Accordingly, it will be understood that the preferred embodiment and alternative embodiment of the present invention have been disclosed by way of example and that other modifications and alterations may occur to those skilled in the art without departing from the scope and spirit of the appended claims.

What is claimed is:

1. A nested tray and stand combination comprising a stand having a base and a hollow vertical member mounted on the base, the vertical member defining a chamber, a slotted cover mounted on the vertical member enclosing the chamber, a tray nested on the stand by being received on the vertical member, the tray defining a series of peripherally spaced open recesses defined by associated wall and floor parts, said floor parts of each recess being joined in radial alignment with the radially outer floor part inclined downwardly, said walls parts of each recess having ribs projecting from said wall parts located at the juncture of the floor parts to enable containers to be received in said recesses in at least two orientations.

2. A nested tray and stand combination comprising a stand having a base and a hollow vertical member mounted on the base, the vertical member defining a chamber, a slotted cover mounted on the vertical member enclosing the chamber, a tray nested on the stand by being received on the vertical member, the tray defining a series of peripherally spaced open recesses defined by associated wall and floor parts, said walls parts of each recess having elements to enable containers to be received in said recesses in at least two orientations, wherein the tray is annular in configuration, wherein the vertical member is cylindrical, and wherein a divider is mounted in the interior of the cylinder to define an upwardly opening chamber composed of an upper annular platform and a central receptacle.

3. A nested tray and stand combination comprising a stand having a base and a hollow vertical member mounted on the base, the vertical member defining a chamber, a slotted cover mounted on the vertical member enclosing the chamber, a tray nested on the stand by being received on the vertical member, the tray defining a series of peripherally spaced open recesses defined by associated wall and floor parts, said walls parts of each recess having elements to enable containers to be received in said recesses in at least two orientations, wherein the tray is annular in configuration, wherein the vertical member is cylindrical, and wherein the lower end of the cylinder is slotted.

4. A nested tray and stand combination as defined in claim 2 wherein the slotted cap is received on the top of the cylinder.

5. A nested tray and stand combination as defined in claim 4 wherein cotton absorbent material saturated with a solvent fills the receptacle and platform and is exposed through the slotted cap.

* * * * *